US009539551B2

(12) United States Patent
Brown et al.

(10) Patent No.: US 9,539,551 B2
(45) Date of Patent: Jan. 10, 2017

(54) MIXING APPARATUS OF THE CDDM-AND/OR CTM-TYPE, AND ITS USE

(75) Inventors: Christopher John Brown, Derbyshire (GB); Graeme Neil Irving, Wirral (GB); Adam Jan Kowalski, Wirral (GB)

(73) Assignee: CDDM Technology Limited, London (GB)

( * ) Notice: Subject to any disclaimer, the term of this patent is extended or adjusted under 35 U.S.C. 154(b) by 0 days.

(21) Appl. No.: 13/146,651

(22) PCT Filed: Feb. 3, 2010

(86) PCT No.: PCT/EP2010/051295

§ 371 (c)(1),
(2), (4) Date: Jan. 23, 2012

(87) PCT Pub. No.: WO2010/091983

PCT Pub. Date: Aug. 19, 2010

(65) Prior Publication Data

US 2012/0113743 A1 May 10, 2012

(30) Foreign Application Priority Data

Feb. 9, 2009 (GB) ..... 0901954.8

(51) Int. Cl.
*B01F 7/00* (2006.01)
*B01F 3/08* (2006.01)

(52) U.S. Cl.
CPC ..... *B01F 7/00775* (2013.01); *B01F 7/00816* (2013.01); *B01F 3/08* (2013.01)

(58) Field of Classification Search
CPC ..... B01F 7/00775; B01F 7/00816
USPC ..... 366/176.1, 181.4, 293–296
See application file for complete search history.

(56) References Cited

U.S. PATENT DOCUMENTS

| | | | | | |
|---|---|---|---|---|---|
| 333,788 | A | * | 1/1886 | Smout | 99/524 |
| 2,744,287 | A | * | 5/1956 | Parshall et al. | 425/208 |
| 2,969,960 | A | * | 1/1961 | Gurley, Jr. | 366/303 |
| 3,009,685 | A | * | 11/1961 | Rettig | 366/75 |
| 3,194,540 | A | * | 7/1965 | Hager | 366/305 |
| 3,333,828 | A | * | 8/1967 | Boehme | 366/305 |
| 3,580,545 | A | * | 5/1971 | O'Brien | 425/222 |
| RE29,053 | E | * | 11/1976 | Cumpston, Jr. | 241/260 |
| 4,129,389 | A | * | 12/1978 | Wakeman et al. | 366/144 |
| 4,419,014 | A | * | 12/1983 | Gale | 366/99 |
| 4,421,413 | A | * | 12/1983 | Sekiguchi | 366/307 |
| 4,582,433 | A | * | 4/1986 | Mehta | 366/76.1 |
| 4,680,132 | A | * | 7/1987 | Clarke et al. | 510/481 |
| 4,840,810 | A | * | 6/1989 | Bodor et al. | 426/312 |
| 4,844,928 | A | * | 7/1989 | van Heteren et al. | 426/312 |
| 5,421,650 | A | * | 6/1995 | Meyer | 366/88 |
| 5,599,507 | A | * | 2/1997 | Shaw et al. | 422/135 |

(Continued)

*Primary Examiner* — Walter D Griffin
*Assistant Examiner* — Abbas Rashid
(74) *Attorney, Agent, or Firm* — Bracewell LLP; Linda L. Morgan

(57) ABSTRACT

A distributive and dispersive mixing apparatus comprising two confronting surfaces (1,2) having cavities (3) therein which on relative motion of the surfaces function as a cavity transfer mixer (CTM) or controlled deformation dynamic mixer (CDDM) or both, CHARACTERISED IN THAT the normal separation of the confronting surfaces varies in the direction of bulk flow, so as to define a plurality of regions of successive closer and wider spacing of the confronting surfaces.

7 Claims, 6 Drawing Sheets

(56) References Cited

U.S. PATENT DOCUMENTS

| | | | | |
|---|---|---|---|---|
| 5,779,986 | A * | 7/1998 | van Endert et al. | 422/136 |
| 6,227,193 | B1 * | 5/2001 | Selivanov | 126/247 |
| 6,354,729 | B1 * | 3/2002 | Brown | 366/304 |
| 6,550,956 | B1 * | 4/2003 | Utracki et al. | 366/176.2 |
| 7,124,970 | B2 * | 10/2006 | Kirjavainen | 241/261.1 |
| 2003/0142582 | A1 * | 7/2003 | Utracki et al. | 366/176.2 |
| 2004/0052156 | A1 * | 3/2004 | Brown | 366/286 |
| 2004/0159971 | A1 * | 8/2004 | Kirjavainen | 264/211 |

* cited by examiner

MIXING APPARATUS OF THE CDDM-AND/OR CTM-TYPE, AND ITS USE

TECHNICAL FIELD

The present invention relates to mixing apparatus for fluids and in particular, to flexible mixing devices which can provide a range of mixing conditions.

BACKGROUND OF THE INVENTION

It is recognised that mixing can be described as either distributive or dispersive. In a multi-phase material comprising discrete domains of each phase, distributive mixing seeks to change the relative spatial positions of the domains of each phase, whereas dispersive mixing seeks to overcome cohesive forces to alter the size and size distribution of the domains of each phase. Most mixers employ a combination of distributive or dispersive mixing although, depending on the intended application, the balance will alter. For example, a machine for mixing peanuts and raisins will ideally be wholly distributive so as not to damage the things being mixed, whereas a blender/homogeniser will be dispersive.

Many different types of rotor/stator mixer are known. Flow-through stirring reactors such as those disclosed in US 2003/0139543 comprise a vessel with internally mounted mixing elements and are generally distributive in function. The direction of bulk flow within such a mixer is from the inlet port to the outlet port.

Other types of rotor-stator mixer (such as that disclosed in WO 2007/105323 are designed with the intention of forming fine emulsions and are dispersive in character. DE 1557171 discloses a mixer with a plurality of alternately rotating and static, concentric cage-like elements through which the direction of bulk flow is radial.

Figure 1:
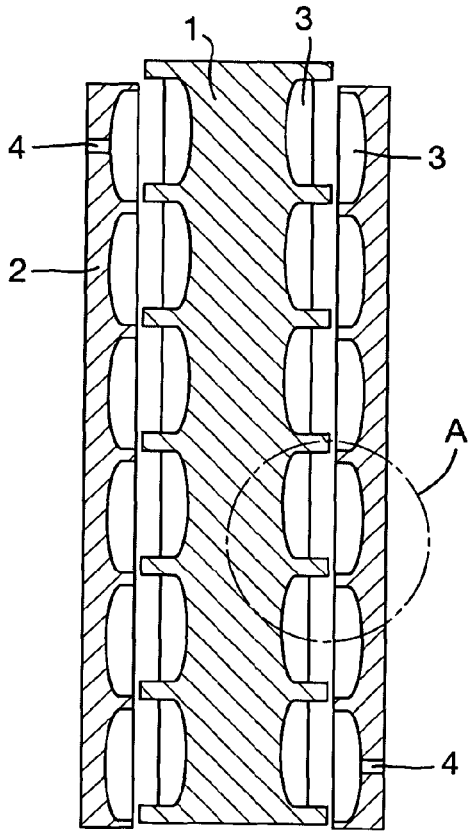

EP 0048590, EP 0799303 and GB 2118058 describe a known mixer type hereinafter referred to as a "Cavity Transfer Mixer" (CTM). The CTM comprises elements which define confronting surfaces, each having a series of cavities formed therein, in which the surfaces move relatively to each other and in which a liquid material is passed between the surfaces and flows along a pathway successively passing through the cavities in each surface. In FIG. 1 of GB 2118058, the confronting surfaces are the inner surface of a sleeve and the outer surface of a co-axially disposed inner drum. The cavities are arranged so that they overlap, forming sinuous flow paths which change as the drum and the sleeve rotate relative to each other. The type of mixer shown in GB 2118058 has stator and rotor elements with opposed cavities which, as the mixer operates, move past each other across the direction of bulk flow through the mixer. In such CTM-type mixers, primarily distributive mixing is obtained. Shear is applied by the relative movement of the surfaces in a generally perpendicular direction to the bulk flow of material along the mixer. In such a device there is relatively little variation in the cross-sectional area for flow as the material passes axially down the device. Generally, the cross-sectional area for flow (due to the cavities) varies by a factor of less than 3 through the apparatus. Absent the cavities, the "metal to metal" separation between the inner surface of the sleeve and the surface of the drum is essentially constant.

The commercial application of CTMs has been largely restricted to the thermoplastics' conversion industry, where CTM technology originated (see EP 048590). In part this is because established rotor/stator devices, such as "Silverson" mixers, offer some of the benefits and at a significantly lower cost.

In some mixers, such as that described in EP 0434124 a cage-like rotor and stator elements are configured such that the bulk flow must pass through relatively narrow spaces within the mixer. Similar alternation of relatively wide and relatively narrow flow spaces, for the purpose of forming an emulsion, are known from GB 129757. GB 129757 discloses a mixer in which the confronting surfaces are formed between two conical members, located one within the other. The inner conical member is a rotor and has two semicircular, circumferential and horizontally disposed grooves which, together with similar grooves on the confronting surface of the outer conical member define annular mixing chambers between regions of high extensional flow. A further feature of the mixer disclosed in GB 129757 is that the spacing between the confronting surfaces tapers in the direction of bulk flow, such that the normal spacing between the surfaces (i.e. the spacing ignoring the grooves) is reduced in the direction of bulk flow.

GB 129757 and EP 0434124 are not CTM's as the relatively wide spaces within the mixers form annuli and there it little or no alteration of the flow path geometry as the rotor and stator move.

EP 0799303 describes a mixer, hereinafter referred to as a "Controlled Deformation Dynamic Mixer" (CDDM). In common with the CTM, this type of mixer has stator and rotor elements with confronting surfaces having opposed cavities which, as the mixer operates, move past each other across the direction of bulk flow through the mixer. The CDDM is distinguished from the CTM in that material is also subjected to extensional deformation. The extensional flow and efficient dispersive mixing is secured by having confronting surfaces with cavities arranged such that the cross sectional area for bulk flow of the liquid through the mixer successively increases and decreases by a factor of at least 5 through the apparatus. In comparison with the embodiment of the CTM described above, the cavities of the CDDM are generally aligned or slightly offset in an axial direction such that material flowing axially along the confronting surfaces is forced through narrow gaps as well as flowing along and between the cavities. The CDDM combines the distributive mixing performance of the CTM with dispersive mixing performance. Thus, the CDDM is better suited to problems such as reducing the droplet size of an emulsion, where dispersive mixing is essential. As with the CTM disclosed in GB 2118058, the normal spacing of the confronting surfaces (absent the cavities) in the CDDM is constant along the length of the mixer. GB 129757 does not disclose a CDDM mixer because although regions of dispersive extensional flow alternate with distributive mixing zones, the distributive mixing zones are annular and do not have the CTM-like mixing action across the bulk flow through the mixer.

GB 2308076 shows several embodiments of a mixer comprising a co-called "sliding vane" pump. These include both drum/sleeve types where the bulk flow is along the axis of the mixer and mixers in which the flow is radial. Many other types of mixer can be configured either as the drum/sleeve type or the "flat" type. For example DD207104 and GB 2108407 show a mixer comprising two movable confronting surfaces with projecting pins which cause mixing in material flowing in a radial direction between the plates.

Both the CTM and the CDDM can be embodied in a "flat" form where the drum and the sleeve are replaced with a pair of disks mounted for relative rotation and the cavities are provided in the confronting surfaces of the disks. In this modified "flat" form the bulk flow is generally radial.

An important further consideration in certain CDDM designs concerns the relative axial positions of rotor and stator components during operation which are critical to performance. Such relative positions may change by axial displacement of the rotating parts with respect to the static parts and this may compromise critical clearances. Under "normal" operating conditions, such displacement is resisted through thrust bearings, an approach which becomes more difficult at high pressures and mixer speeds.

There are practical limits to the spacing between the confronting surfaces in the CDDM and CTM. As the device is heated, expansion may mean that the rotor/drum expands in a radial direction. The stator/sleeve may expand less as it is better able to lose heat. This can result in a narrowing of the gap between the confronting surfaces and even contact. At high operating speeds, contact between the surfaces can be catastrophic.

Further difficulties arise from the high shear rates which are encountered in mixers with very closely confronting surfaces. High shear rates lead to high shear stress (which is a function of shear rate and viscosity). These shear stresses lead to a high torque (which is related to the shear stress for a given geometry). For a fixed angular velocity of the mixing elements the power consumption is directly related to the torque. Hence mixers which employ high shear rates typically require large power inputs. This is not only adds cost, but can produce unwanted or uncontrolled heating of the material being processed.

BRIEF DESCRIPTION OF THE INVENTION

We have determined that by varying the normal separation of the confronting surfaces in CTM/CDDM type mixers, it is possible to confine the most intense shear to relatively few regions.

According to a first aspect of the present invention there is provided a distributive and dispersive mixing apparatus comprising two confronting surfaces having cavities therein which on relative motion of the surfaces function as a cavity transfer mixer or controlled deformation dynamic mixer or both, CHARACTERISED IN THAT the normal separation of the confronting surfaces varies in the direction of bulk flow, so as to define a plurality of regions of successive closer and wider spacing of the confronting surfaces.

The presence of a CTM-like or CDDM-like series of circumferentially disposed series of cavities in at least one of the regions of wider spacing of the confronting surfaces is an essential feature of the invention. There may be one such series of cavities between each of the regions of closer spacing (apart from at the ends of the mixer) or there may be more than one such series in some or all of the regions of wider spacing.

A CDDM-type mixer configuration is preferred for the relative positioning of the cavities in the confronting surfaces. In such a configuration, the regions of wider spacing between the confronting surfaces are provided with at least one circumferentially disposed series of cavities, and the regions of narrow spacing are annular and not by passed by flow in and through cavities.

The regions where the confronting surfaces are most closely spaced are those where the shear rate within the mixer tends to be the highest. As noted above high shear contributes to power consumption and heating. This is especially true where the confronting surfaces of the mixer are spaced by a gap of less than around 50 microns. Advantageously, confining the regions of high shear to relatively short regions means that the power consumption and the heating effect can be reduced, especially in the regions the confronting surfaces are spaced apart relatively widely. A further benefit of this variation in the normal separation of the confronting surfaces in the direction of bulk flow, is that by having relatively small regions of high shear, especially with a low residence time is that the pressure drop along the mixer can be reduced without a compromise in mixing performance. We have determined that by machining back the confronting surfaces in the wider-spaced regions such that the clearance between the confronting surfaces is at least 2 times that of the closer regions, preferably 3-20 times that of the closer regions, a very significant power requirement reduction and reduction in operating pressure are obtained.

In an embodiment of the present invention at least one cage-like member is disposed between the confronting surfaces. The surfaces of the cage like member conform in profile to the confronting surfaces against which they are disposed and the cage like member is stepped such that a mixer of the same type as that described above is formed between the at least one surface of the cage like member and at least one of the confronting surfaces. Flow of material through the apertures in the cage like member promotes further distributive mixing in the more widely spaced regions of the confronting surfaces. A cage-like member promotes regions where the flow is highly extensional allowing the mixer to operate at lower pressures than would otherwise be the case. Preferably the or at least one cage-like member has a relative rotational movement but is not freely rotating relative to at least one of the confronting surfaces and/or at least one other cage-like member, and the bulk fluid flow within the mixing apparatus is in the plane of the surface of the or at least one cage-like member.

A further beneficial modification of the apparatus is to ensure that regions of axially disposed confronting surfaces alternate with regions of radially disposed confronting surfaces thereby preventing any leakage or plug-like flow through the mixer. Axially and radially preferably being defined as being with 20 and preferably within 10 degrees of the relevant direction.

A further aspect of the present invention subsists in the use of the mixing apparatus of the present invention for the treatment of a liquid, emulsion, gel or other flowable composition.

Typical embodiments of the invention take the form of a stator/rotor drum/sleeve mixer. However, both the CTM and the CDDM can be embodied in a "flat" form where the drum and the sleeve are replaced with a pair of disks mounted for relative rotation and the cavities are provided in the confronting surfaces of the disks.

DETAILED DESCRIPTION OF THE INVENTION

For the purposes of understanding the operation of the CTM or CDDM in general, the disclosures of EP 48590, EP 799303, GB 2118058 and WO96/20270 are incorporated herein by reference. As noted above, the apparatus of the present invention is similar to the CTM and CDDM in that it comprises two confronting surfaces and differs in that the bulk flow path for liquid along these confronting surfaces through the mixer varies significantly in width as measured between the surfaces and ignoring cavities.

As with the CTM and the CDDM there are several possible configurations for the mixing apparatus of the present invention. In one preferred combination the confronting surfaces are cylindrical. In such a configuration the apparatus will generally comprise a cylindrical drum and co-axial sleeve. The confronting surfaces will be defined by the outer surface of the drum and the inner surface of the sleeve. However, there are alternative configurations in which the confronting surfaces are circular and generally disc-shaped. Between these two extremes of configuration are those in which the confronting surfaces are conical or frusto-conical and (when present) the, or each, cage-like member is generally conical or frusto-conical. Non-cylindrical embodiments allow for further variation in the shear in different parts of the flow through the mixer.

The conical configuration of the mixer has an advantage over the cylindrical configuration in that it is easier to machine the cavities in the inside surface of the outermost confronting surface.

While a typical mixer according to the present invention will either have CTM- or CDDM-like juxtaposition of cavities, it is possible for a mixer according to the invention to be provided with one on more regions in which the juxtaposition is such that the arrangement is CTM-like and one or more regions in which the arrangement is CDDM-like. As can be seen from the figures the process-stream in the mixer encounters, sequentially, a plurality of regions which are CTM-like or CDDM-like (the more widely spaced regions of the confronting surfaces) followed by regions in which the confronting surfaces are much more closely spaced and which bear some functional similarity to a spinning-disk homogenizer.

Preferably, there are 3-20 of the regions of distributive mixing (those with the more widely spaced confronting surfaces) and a comparable number of the regions of dispersive mixing (those with the more closely spaced confronting surfaces). More preferably, there are 6-12 such pairs of regions. Although these pairs of regions can comprise parts of the apparatus which are manufactured separately and then secured together it is preferable that both the confronting surfaces and cavities therein are of monolithic construction, i.e. machined out of single pieces of metal.

For devices constructed as concentric cylinders in which the bulk flow is axial, then the rotational shear rate in CTM- or CDDM-like mixers of conventional design is independent of axial position. And for such devices constructed as concentric discs in which the bulk flow is radial, then the rotational shear rate is directly dependent upon radial position.

Additional features of the known CTM and CDDM may be incorporated in the mixer described herein. For example, one or both of the confronting surfaces may be provided with means to heat or cool it. Where cavities are provided in the confronting surfaces these (and also the apertures in the cage-like member) may have a different geometry in different parts of the mixer to as to further vary the shear conditions. The operating parameters of the mixing apparatus according to the present invention will vary according to the application envisaged. For example where the process stream is of low viscosity emulsion the apparatus will typically have a rotor speed of more than 1000 rpm and a residence time which could be as low as of tens of microseconds. The closest confronting surfaces will typically be 50 microns or less apart, preferably with a separation in the range 10-50 microns. For more viscous materials the rotation speed will be lower and the residence time longer.

Figure 2:
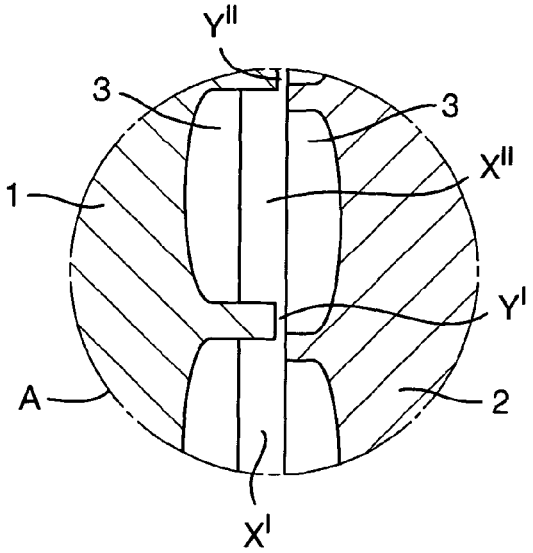
Figure 3:
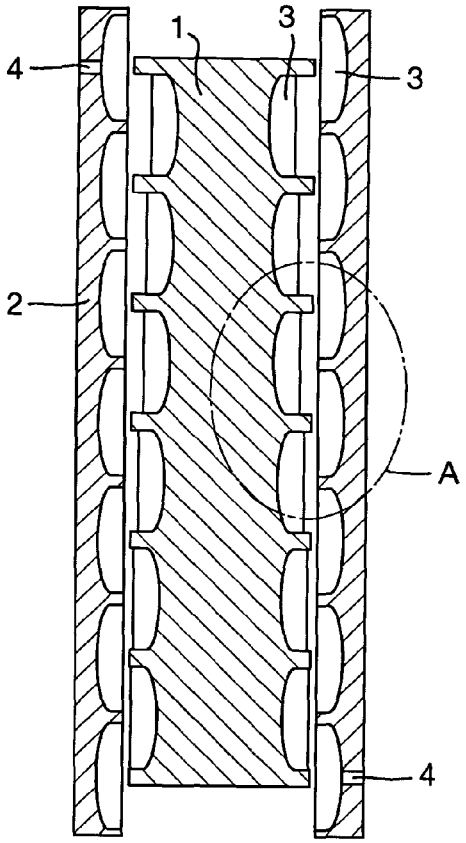
Figure 4:
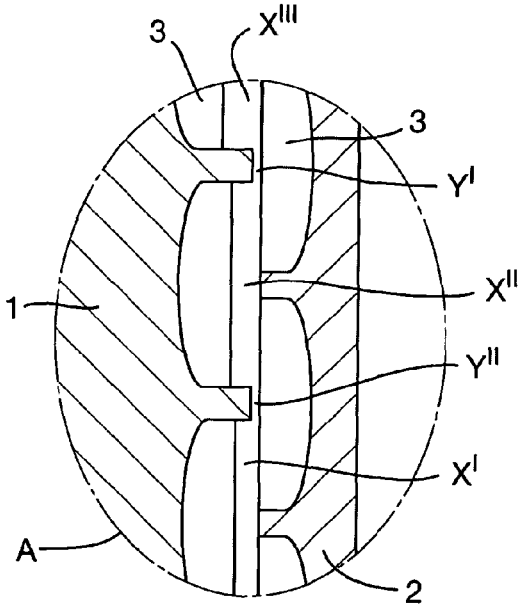
Figure 5:
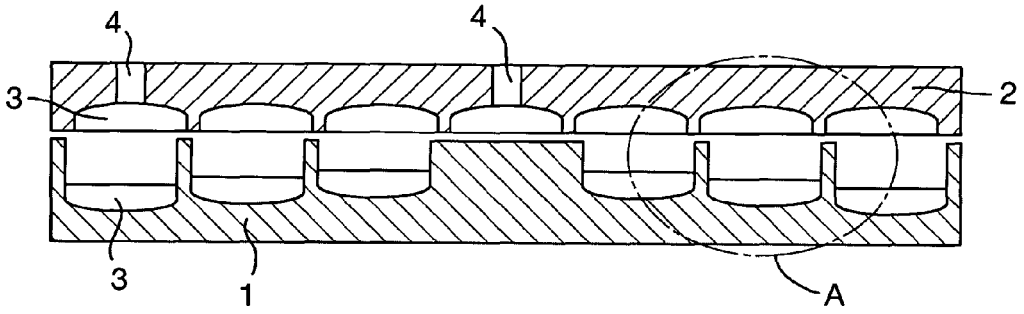
Figure 6:
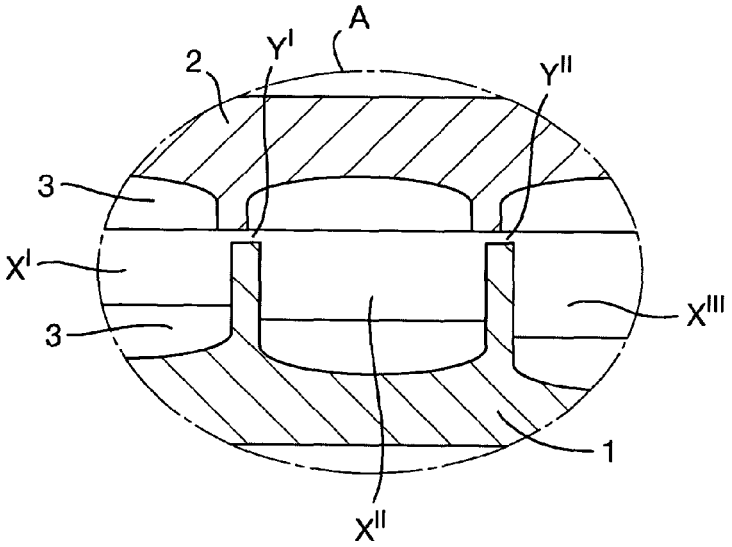
Figure 7:
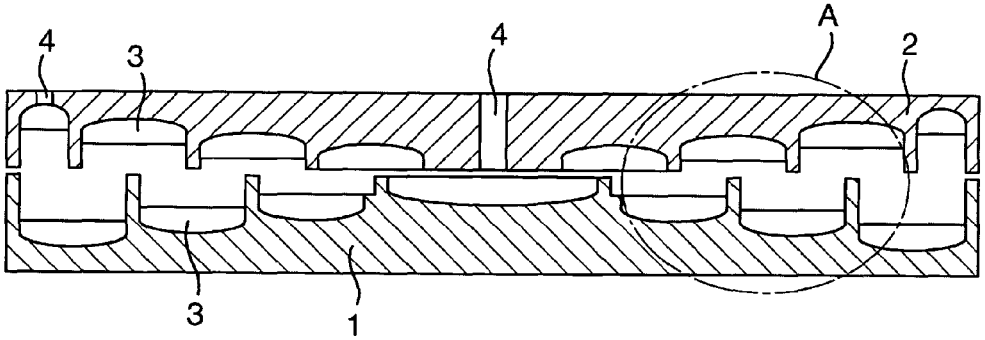
Figure 8:
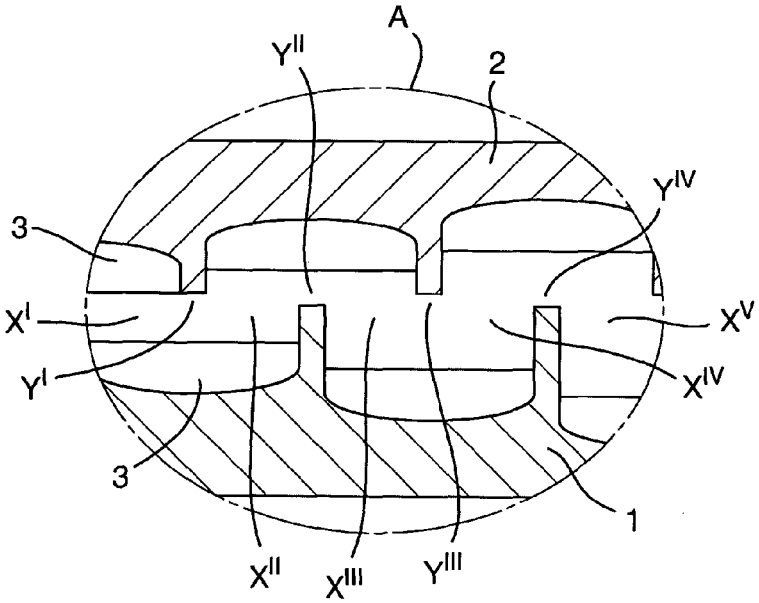
Figure 9:
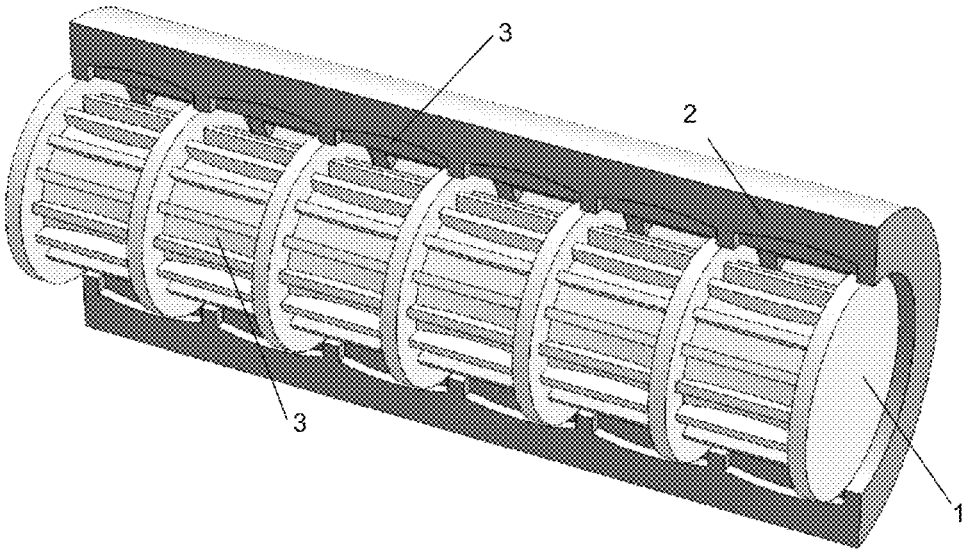

In order that the present invention can be better understood it will be described by way of example and with reference to the accompanying figures which relate to devices of modular construction, in which:

FIG. 1: shows an axial section through a relieved rotating cylindrical drum and static co-axial sleeve controlled deformation dynamic mixer (CDDM) according to the invention;

FIG. 2: shows a detailed view of region "A" in FIG. 1;

FIG. 3: shows an axial section through a relieved rotating cylindrical drum and static co-axial sleeve cavity transfer mixer (CTM) which is according to a less preferred embodiment of the invention;

FIG. 4: shows a detailed view of region "A" in FIG. 3;

FIG. 5: shows an axial section through a relieved rotating and static disc controlled deformation dynamic mixer (CDDM) according to the invention;

FIG. 6: shows a detailed view of region "A" in FIG. 5;

FIG. 7: shows an axial section through a relieved rotating and relieved static disc cavity transfer mixer (CTM) according a less preferred embodiment of to the invention;

FIG. 8: shows a detailed view of region "A" in FIG. 7;

FIG. 9: shows a partial section perspective view of the CDDM of FIG. 1.

Figure 10:
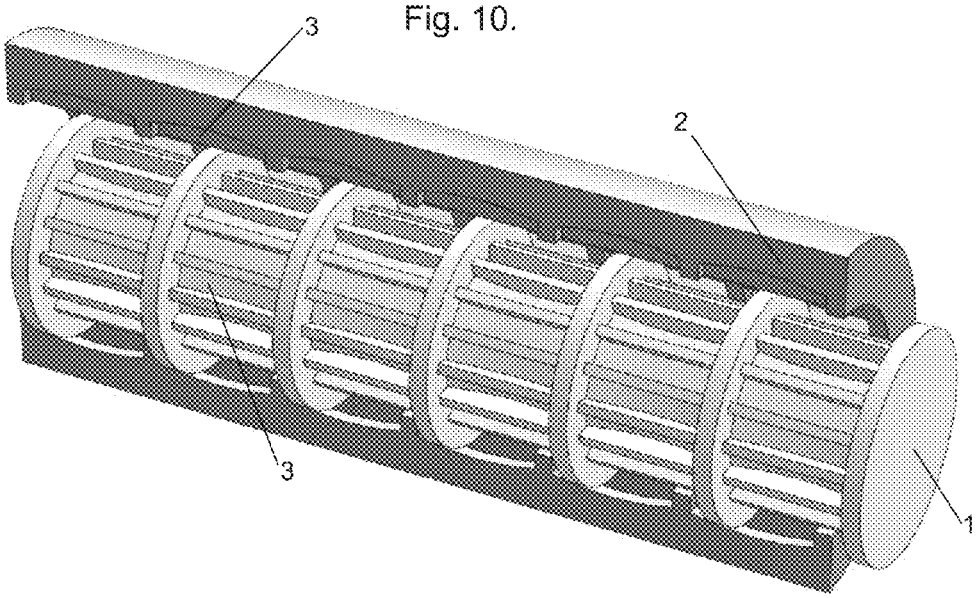

FIG. 10: shows a partial section perspective view of the CDDM of FIG. 3.

Figure 11:
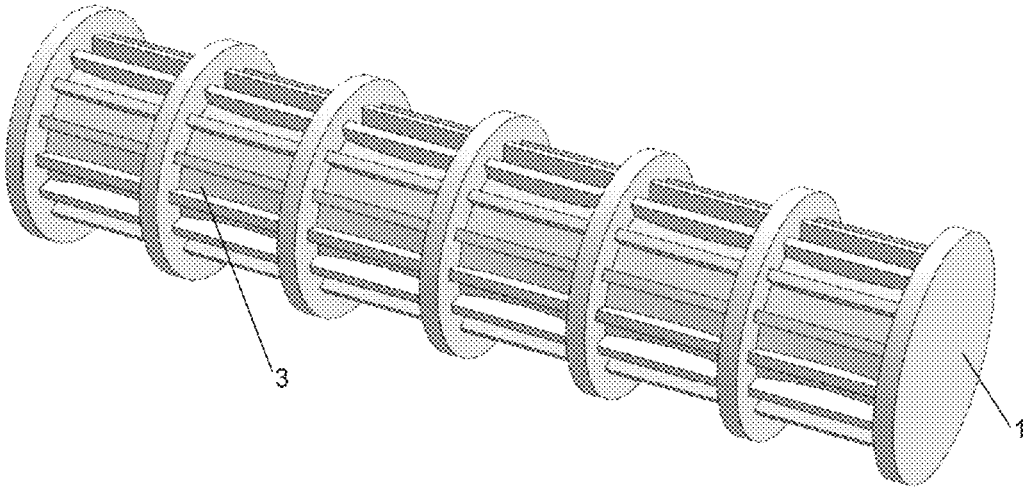

FIG. 11: shows a perspective view of the static co-axial sleeve of FIG. 1.

Figure 12:
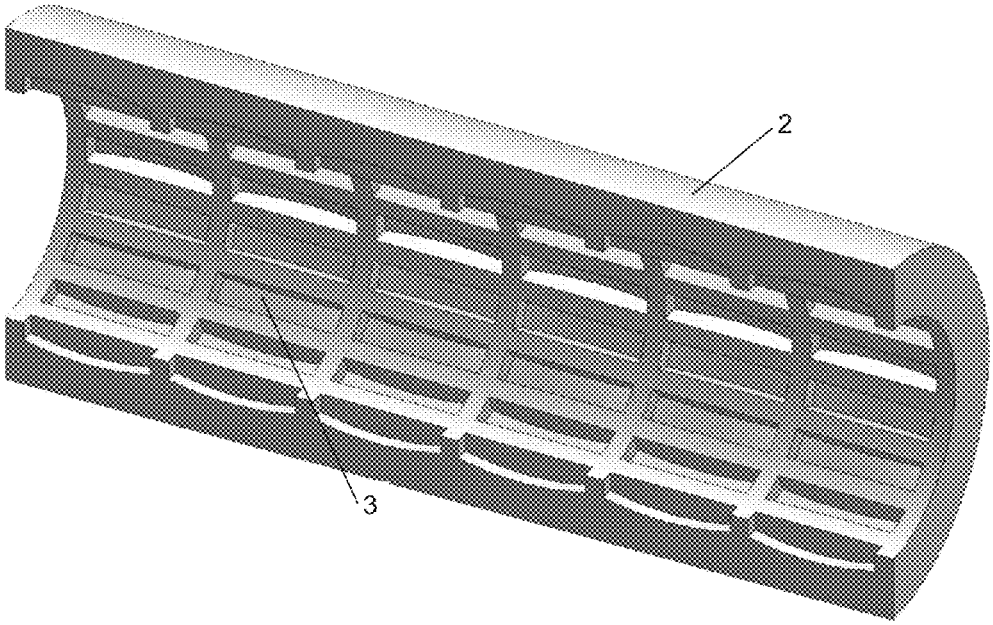

FIG. 12: shows a perspective view of the relieved rotating cylindrical drum of FIG. 1.

EXAMPLES

1. Relieved Rotating Cylindrical Drum and Static Co-Axial Sleeve CDDM

FIG. 1 shows a portion of a mixer comprising an inner drum (1) and an outer sleeve (2). Cavities (3) are provided in the drum and the sleeve so that as the drum rotates about its axis (shown dashed), the drum and the sleeve co-operate to form a controlled deformation dynamic mixer (CDDM). Ports (4) are provided for input and output of the process flow. Means for rotating the drum relative to the sleeve and end seals are not shown. Flow of materials within the mixer is from the bottom towards the top.

FIG. 2 provides a more detailed view of the region "A" in FIG. 1. It can be seen that in regions "$X^I$" and "$X^{II}$" the surface of the drum (1) is relieved and the radial spacings of the confronting surfaces of the drum (1) and the sleeve (2) are relatively large as compared with the corresponding radial spacings in regions "$Y^I$" and "$Y^{II}$". In regions $X^I$ and $X^{II}$ the cavities (3) promote CTM-like distributive mixing while in regions $Y^I$ and $Y^{II}$ the narrow spacing in the flow path induces extensional flow and CDDM-like dispersive mixing. In this particular embodiment of the mixer the radial spacings in regions $X^I$ and $X^{II}$ are constant, and the radial spacings in regions $Y^I$ and $Y^{II}$ are also constant. An important feature of this embodiment is that the gaps at $Y^I$ and $Y^{II}$ are annular as there is at least some overlap of the wider portion of the drum (1) and the lands between the circumferentially disposed groups of cavities in the sleeve (2). This feature is common to a preferred series of embodiments in which the general configuration is more similar to the CDDM.

The radial spacings in regions $X^I$ and $X^{II}$ are significantly greater than those in the regions $Y^I$ and $Y^{II}$ (which can be as close as less than 50 microns and are not drawn to scale in the figures). Hence the torque required to rotate the mixer is significantly reduced, so reducing the energy input and product temperature increase. Further, this reduces the element of dispersive mixing in the regions of CTM-like behaviour, $X^I$ and $X^{II}$. By so doing there is greater control of elements of the process history, principal amongst which are thermal homogeneity, temperature rise and shear/extension, each of which can impact on the performance of certain products and intermediates.

2. Relieved Rotating Cylindrical Drum and Static Co-Axial Sleeve CTM

FIG. 3 shows a portion of a mixer comprising an inner drum (1) and an outer sleeve (2). Cavities (3) are provided in the drum and the sleeve so that as the drum rotates about its axis (shown dashed), the drum and the sleeve co-operate to form a cavity transfer mixer. Ports (4) are provided for input and output of the process flow. Means for rotating the drum relative to the sleeve and end seals are not shown. Flow of materials within the mixer is from the bottom towards the top.

FIG. 4 provides a more detailed view of the region "A" in FIG. 3. It can be seen that in regions "$X^I$", "$X^{II}$" and "$X^{III}$" the surface of the drum (1) is relieved and the radial spacings of the confronting surfaces of the drum (1) and the sleeve (2) are relatively large as compared with the corresponding radial spacings in regions "$Y^I$" and "$Y^{II}$". In regions $X^I$, $X^{II}$ and $X^{III}$ the cavities (3) promote CTM-like distributive mixing while in regions $Y^I$ and $Y^{II}$ the narrow spacing in the flow path induces an element of extensional flow and CDDM-like dispersive mixing. In this particular embodiment of the mixer the radial spacings in regions $X^I$, $X^{II}$ and $X^{III}$ increase in the direction of flow, while the radial spacings in regions $Y^I$ and $Y^{II}$ are constant.

The radial spacings in regions $X^I$, $X^{II}$ and $X^{III}$ are significantly greater than those in the regions $Y^I$ and $Y^{II}$. Hence the torque required to rotate the mixer is significantly reduced, so reducing the energy input and product temperature increase. Further, this reduces the element of dispersive mixing in the regions of CTM-like behaviour, $X^I$, $X^{II}$ and $X^{III}$. By so doing there is greater control of elements of the process history, principal amongst which are thermal homogeneity, temperature rise and shear/extension, each of which can impact on the performance of certain products and intermediates.

This example illustrates a class of embodiment which is less preferred than that shown in FIGS. 1 and 2. In particular, the region of narrow spacing between the widest part of the drum and the inner surface of the sleeve is now in part crossed by the cavities in the inner wall of the sleeve, which allow some or all of the bulk flow to avoid the regions of high shear $Y^I$ and $Y^{II}$.

3. Relieved Rotating Disc and Static Disc CDDM

FIG. 5 shows a portion of a mixer comprising a rotating disc (1) and a static disc (2). Cavities (3) are provided in the rotating disc and static disc so that as the former rotates about its axis (shown dashed), the rotating disc and static disc co-operate to form a controlled deformation dynamic mixer. Ports (4) are provided for input and output of the process flow. Means for rotating the rotating disc relative to the static disc and end seals are not shown. Flow of materials within the mixer is from the centre towards the periphery.

FIG. 6 provides a more detailed view of the region "A" in FIG. 5. It can be seen that in regions "$X^I$", "$X^{II}$" and "$X^{III}$" the surfaces of the rotating disc (1) are relieved and the axial spacings of the confronting surfaces of the rotating disc (1) and the static disc (2) are relatively large as compared with the corresponding axial spacings in regions "$Y^I$" and "$Y^{II}$". In regions $X^I$, $X^{II}$ and $X^{III}$ the cavities (3) promote CTM-like distributive mixing while in regions $Y^I$ and $Y^{II}$ the narrow spacing in the flow path induces extensional flow and CDDM-like dispersive mixing. In this particular embodiment of the mixer the axial spacings in regions $X^I$, $X^{II}$ and $X^{III}$ increase in the direction of flow, while the radial spacings in regions $Y^I$ and $Y^{II}$ are constant.

The axial spacings in regions $X^I$, $X^{II}$ and $X^{III}$ are significantly greater than those in the regions $Y^I$ and $Y^{II}$. Hence the torque required to rotate the mixer is significantly reduced, so reducing the energy input and product temperature increase. Further, this reduces the element of dispersive mixing in the regions of CTM-like behaviour, $X^I$, $X^{II}$ and $X^{III}$. By so doing there is greater control of elements of the process history, principal amongst which are thermal homogeneity, temperature rise and shear/extension, each of which can impact on the performance of certain products and intermediates.

4. Relieved Rotating Disc and Relieved Static Disc CTM

FIG. 7 shows a portion of a mixer comprising a rotating disc (1) and a static disc (2). Cavities (3) are provided in the rotating disc and static disc so that as the former rotates about its axis (shown dashed), the rotating disc and static disc co-operate to form a cavity transfer mixer. Ports (4) are provided for input and output of the process flow. Means for rotating the rotating disc relative to the static disc and end seals are not shown. Flow of materials within the mixer is from the centre towards the periphery.

FIG. 8 provides a more detailed view of the region "A" in FIG. 7. It can be seen that in regions "$X^I$", "$X^{II}$", "$X^{III}$" and "$X^{IV}$" the surfaces of the rotating disc (1) and static disc (2) are relieved and the axial spacings of the confronting surfaces of the rotating disc (1) and the static disc (2) are large and significantly increase in the direction of flow. Neither the rotating disc in regions "$Y^{II}$" and "$Y^{IV}$" nor the static disc in regions "$Y^I$" and "$Y^{III}$" are relieved, thus limiting the tendency for radial leakage flow induced by such large axial spacings. As with example 2, this is a less preferred embodiment of the invention as it is of the class of embodiments in which the narrower part of the spacing between the confronting surfaces is crossed by the mixing cavities.

By relieving both surfaces, the axial spacings in regions $X^I$, $X^{II}$, $X^{III}$ and $X^{IV}$ and $Y^I$, $Y^{II}$, $Y^{III}$ and $Y^{IV}$ are significantly increased. Hence the torque required to rotate the mixer is significantly reduced, so reducing the energy input and product temperature increase. This significantly reduces the element of dispersive mixing. By so doing there is greater control of thermal homogeneity and local temperature rise, each of which can impact on the performance of certain products and intermediates.

The invention claimed is:

1. A distributive and dispersive mixing apparatus comprising:

a material inlet port (4) and a material outlet port (4) having a direction of bulk material flow defined therebetween; and two confronting surfaces (1, 2), each of the confronting surfaces having discrete cavities (3) therein, which on relative motion of the surfaces (1, 2) function as a cavity transfer mixer or controlled deformation dynamic mixer or both, CHARACTERISED IN THAT a normal separation of the two confronting surfaces (1, 2), which is the separation of said surfaces in the absence of said discrete cavities (3), varies in the direction of bulk material flow, so as to define a plurality of regions of successively closer ($Y^{I}$, $Y^{II}$, $Y^{III}$, $Y^{IV}$) and wider spacing ($X^{I}$, $X^{II}$, $X^{III}$, $X^{IV}$, $X^{V}$) of the confronting surfaces (1, 2) in the direction of bulk material flow, the regions of closer spacing ($Y^{I}$, $Y^{II}$, $Y^{III}$, $Y^{IV}$) being defined by annular rings and the regions of wider spacing ($X^{I}$, $X^{II}$, $X^{III}$, $X^{IV}$, $X^{V}$) being defined by annular channels between successive annular rings, wherein a plurality of the discrete cavities (3) are circumferentially disposed in at least one of the annular channels, whereby the separation of said confronting surfaces (1, 2) in the annular channels is greater than the normal separation of the confronting surfaces (1, 2) in adjoining annular rings by a factor of at least 2;

and wherein the annular rings are not by passed by flow in and through the discrete cavities (3), such that the apparatus functions as a controlled deformation dynamic mixer.

2. A mixing apparatus according to claim 1 wherein the confronting surfaces (1, 2) comprise generally cylindrical surfaces.

3. A mixing apparatus according to claim 1 wherein the confronting surfaces (1, 2) comprise generally conical surfaces.

4. A mixing apparatus according to claim 1 wherein the confronting surfaces (1, 2) comprise generally disk-like surfaces.

5. A distributive and dispersive mixing apparatus according to claim 1 wherein the separation of the confronting surfaces (1, 2) in the annular channels is greater than the normal separation of the confronting surfaces (1, 2) in adjoining annular rings by a factor of at least 3 to 20.

6. A mixing device apparatus according to claim 1 further comprising at least one cage-like member disposed between the confronting surfaces (1, 2), the surfaces of the cage-like member conforming in profile to the confronting surfaces (1, 2) against which they are respectively disposed.

7. A mixing device apparatus according to claim 1 further comprising regions of axially disposed confronting surfaces (1, 2) which alternate with regions of radially disposed confronting surfaces (1, 2) thereby preventing any leakage flow through the mixer.

* * * * *